United States Patent [19]

Sarosy et al.

[11] 4,157,844

[45] Jun. 12, 1979

[54] TAILGATE LOCK AND CONTROL ASSEMBLY

[75] Inventors: Edmund F. Sarosy, Birmingham; Stanley Kwasiborski, Jr., Hazel Park, both of Mich.

[73] Assignee: General Motors Corporation, Detroit, Mich.

[21] Appl. No.: 855,401

[22] Filed: Nov. 28, 1977

[51] Int. Cl.[2] ..... E05C 3/26

[52] U.S. Cl. ..... 292/48; 292/336.3; 292/DIG. 43; 292/216

[58] Field of Search ..... 292/48, 52, 336.3, 216, 292/DIG. 14, DIG. 43; 49/40, 279, 370; 296/50, 106

[56] References Cited

U.S. PATENT DOCUMENTS

| | | | |
|---|---|---|---|
| 2,263,065 | 11/1941 | Baldauf | 292/26 |
| 2,769,659 | 11/1956 | Perny et al. | 296/106 |
| 3,645,043 | 2/1972 | Velovicius et al. | 49/370 |

*Primary Examiner*—Richard E. Moore
*Attorney, Agent, or Firm*—K. H. MacLean, Jr.

[57] ABSTRACT

A lock and control assembly for a vehicle tailgate of the type having a pivotal upper window portion and a pivotal lower gate portion which are hinge mounted respectively along a top edge and a bottom edge so that the opposite edges of both meet when in the closed operative position. The assembly includes a pivotal fork bolt supported adjacent the top edge of the gate portion to engage and capture a striker member which is attached to the lower edge of the window when in the closed position. A pivotal detent lever selectively releases the fork bolt and is operatively attached to a first control lever which pivots in one direction to operate the detent lever and release the fork bolt. A second control lever pivots in the opposite direction to release latch mechanisms holding the gate portion in its closed position. A lock cylinder supported in the exterior panel of the gate is aligned with the operating levers and has means to selectively actuate the levers. A tab-like projection on the first lever prevents pivoting of the second lever until release of the fork bolt and window portion to an open position by operation of the first lever. Subsequently, the gate may be opened by pivotal movement of the second lever which releases the latch mechanisms for the gate.

3 Claims, 5 Drawing Figures

TAILGATE LOCK AND CONTROL ASSEMBLY

The subject invention concerns a lock and control assembly for a vehicle tailgate and provides a simple, compact and efficient mechanism to insure that the window portion is first released prior to releasing the gate portion. The window portion is held maintained in its closed position by the capture of a striker bar which is attached to the lower edge of the window. A pivotal fork bolt having a throat portion receives the window striker therein to latch. The fork bolt is held at its window latching position by the hooking action of a detent lever which is operably attached to a first actuating lever of the control assembly. The actuating lever is directly and selectively activated by a portion of a rotatable lock cylinder carried on the outer panel of the gate. A second actuating lever is also positioned for actuation by the same portion of the lock cylinder but cannot be rotated until the first lever is moved to an unlatching position. A projection or blocking portion on the first lever positively prevents rotation of the second lever until the first lever is moved to the unlatched position. Once the first lever is so moved, the second lever may be pivoted by rotation of the lock cylinder to its unlatching position, which releases remote gate latch mechanisms allowing the tailgate to open.

The above-described lock and control assembly is simple and compact compared to known tailgate control devices. These earlier devices have included means to electrically actuate window releases and regulators and remotely controlled gate latch mechanisms. The subject assembly is a centralized unit mounted near the upper edge of the gate portion so that it is in alignment with a key operated actuator mounted on the outer panel of the tailgate for direct operation thereby. Extensive linkage means previously used are avoided by this arrangement and associated alignment and adjustment problems related to said linkages are also minimized.

Further advantages and features of the subject invention will be more readily understood and appreciated after a reading of the following detailed description, reference being had to the accompanying drawings in which a preferred embodiment of the lock and control assembly is illustrated.

IN THE DRAWINGS

Figure 1:
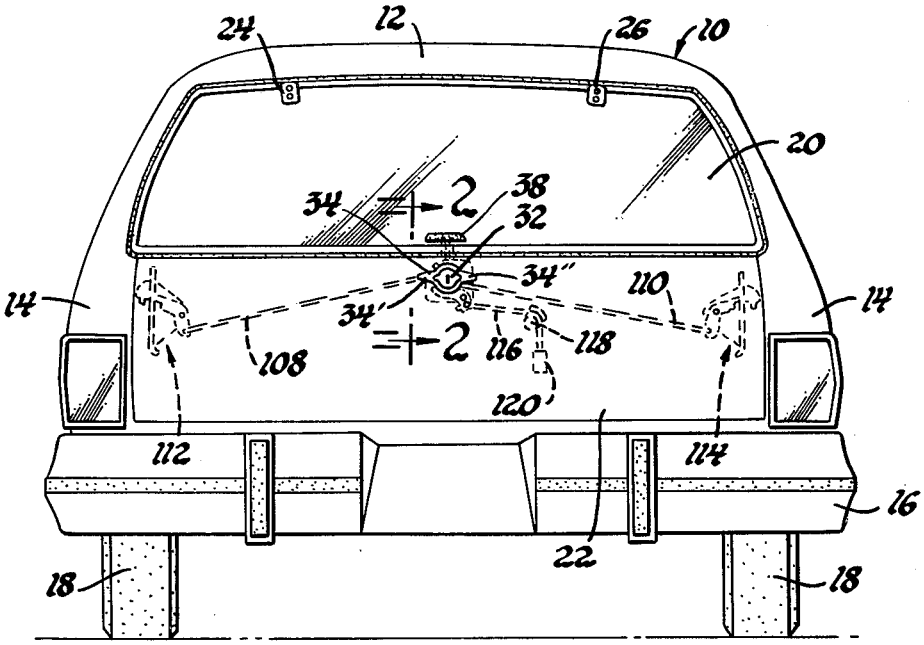
FIG. 1 is an end view of a station wagon type vehicle including a tailgate with the subject lock and control assembly.

In FIG. 1, a vehicle 10 is illustrated, including a roof portion 12, rear quarter panels 14, a bumper 16, wheels 18, and a tailgate assembly which includes an upper window or view portion 20 and a lower gate portion 22. The upper window portion 20 is pivotally supported by hinges 24 and 26 so as to swing outward and then upward as revealed in FIG. 3, which shows the window

Figure 3:
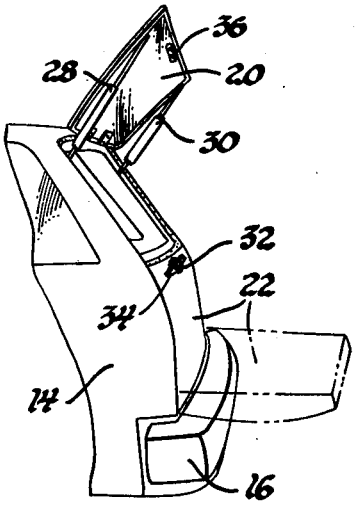
FIG. 3 is a fragmentary perspective view of the rear portion of the vehicle shown in FIG. 1 and illustrating the tailgate in closed and open positions.

20 in an open position. The window 20 is held in the open position by two gas cylinders 28, 30. These devices are commercially available and have been used on previous General Motors vehicles. Also in FIG. 3 shown in phantom lines is the lower gate portion 22 in its open position. The gate portion supports a lock cylinder type actuator 32. The actuator 32 includes a rather conventional keyed cylinder which is enclosed and supported for rotation within a winged operating member 34. Two winged portions 34' and 34'' are provided for easy rotation thereof after the key is inserted in the lock cylinder.

The window portion 20 has a substantially U-shaped or striker bar 36 projecting therefrom which acts as a striker to hold the window in the closed position. The striker bar 36 is connected through the window to an exterior handle portion 38. The striker bar 36 is itself attached to an inner support bar 40 which is itself connected to the handle 38 by fastener members extending through holes in the window as further described.

Figure 2:
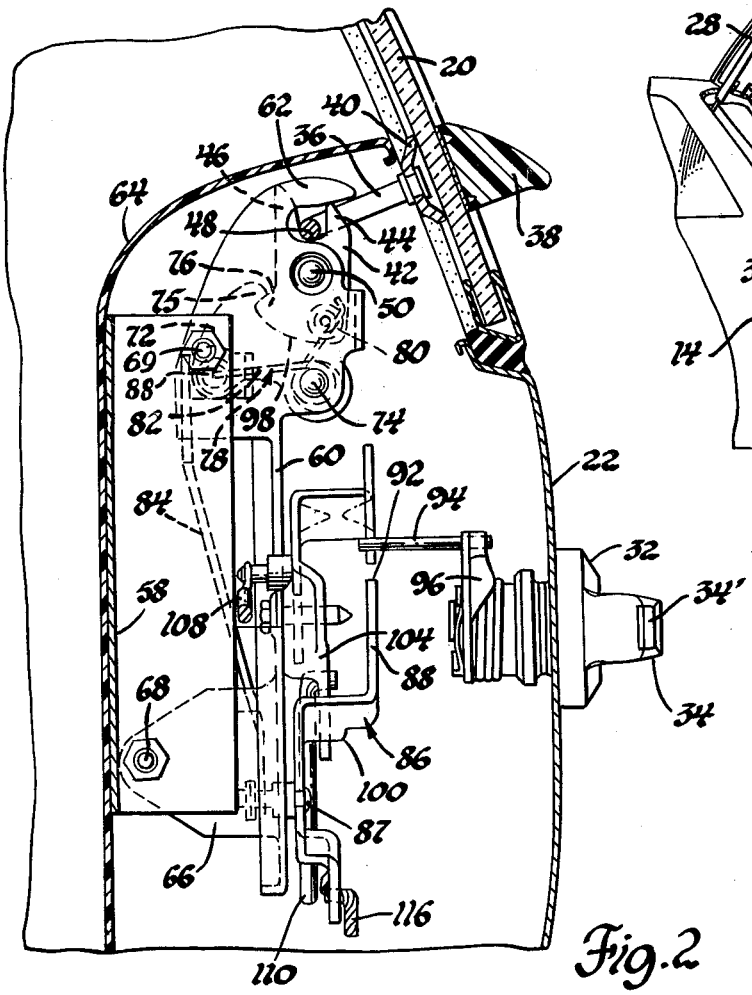
FIG. 2 is an enlarged and fragmentary sectioned view of the tailgate taken along section line 2—2 in FIG. 1 and looking in the direction of the arrows.
Figure 4:
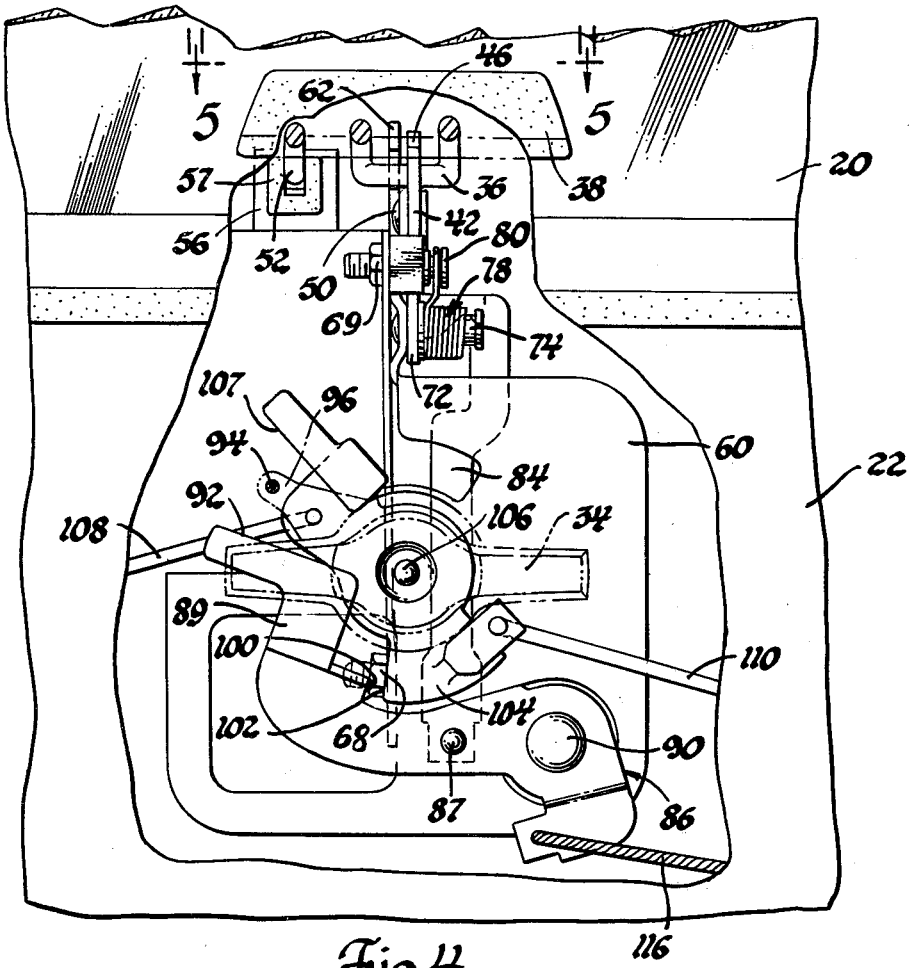
FIG. 4 is an enlarged fragmentary sectioned end view revealing the lock and control assembly from the same perspective as in FIG. 1.
Figure 5:
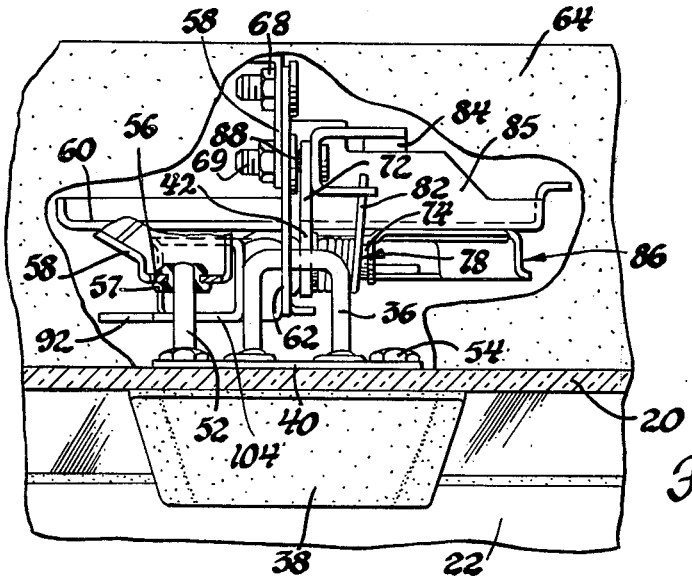
FIG. 5 is an enlarged sectioned view taken along section line 5—5 in FIG. 4 and looking in the direction of the arrows.

The striker bar 36 is engaged or captured when in the closed position by a rotatable fork bolt member 42 which has spaced arms 44, 46 defining a throat portion 48 therebetween. Fork bolt 42 rotates about a rivet-like pin 50. When pivoted counterclockwise to the position shown in FIG. 2, the throat portion 48 and outer arm 44 capture and hold the striker bar 36 in the window closed position shown. FIGS. 4 and 5 also illustrate the relationship between the fork bolt 42 and the striker bar 36, as well as revealing a guide pin member 52 which is attached to the support member 40 and the exterior handle 38. This forms one of two fasteners between members 38 and 40. A second fastener 54 extends through the glass and into gripping relationship with the handle portion 38. A projecting portion of the guide pin 52 extends from the lower edge of the glass inward toward a portion 56 formed in a member 58 supported by the inner gate panel. The portion 56 has an opening therein supporting an elastomeric ferrule 57 with a central aperture therethrough. The pin 52 projects through the opening and into gripping relationship with the ferrule for accurately maintaining a stable lateral placement of the lower edge of the window 20 with respect to the gate portion 22. Thus, for movement of the vehicle over rough roads, lateral movements between the glass and gate are minimized. During closing, contact with arm 46 pivots the fork bolt 42 counterclockwise to the latched position shown in FIG. 2.

Referring back to FIG. 2, a control assembly frame 60 mounted on the inner panel of the gate portion is shown. Frame 60 supports bolt 42 and includes an upper hooked portion 62 which positively captures the striker bar 36 in association with the arms 44, 46 and throat portion 48. The hook portion 62 is concealed in the gate portion and hidden by a decorative cover member 64 which also covers the inner panel 58. The frame 60 is attached to member 58 by conventional means and specifically includes a bracket 66 through which a fastener 68 extends. Another fastener 69 attaches frame 60 and member 58 at an upper end.

Frame 60 also supports a detent lever 72 pivoted about a rivet-like fastener 74 at a location adjacent but below the attachment of fork bolt 42. The detent lever 72 has a hooked end portion 75 which engages a shoulder portion 76 on the fork bolt to maintain it in the latched position shown in FIG. 2. A coil spring member 78 biases the detent lever 72 to the position shown in FIG. 2 and includes a coiled midportion surrounding the fastener 74 and two ends, one of which is secured by a member 80 to bolt 42 while the other 82 is operably connected to the detent lever 72 as will be described.

The detent lever 72 is operably attached by a strap or connector member 84 to a first operating or actuating lever 86 as is best shown in FIG. 4. The upper end portion of the connector 84 is configured to avoid portion 85 of frame 60 as revealed in FIG. 5. A rivet fastener 88 attaches the upper end of the connector 84 to the detent lever 72. The other end 82 of spring 78 engages a lateral flange at the upper end of connector 84 as shown in FIG. 5 to operatively connect spring 78 to the detent lever 72. Connector 84 is fastened to lever 86 by a fastener 87 as seen in FIG. 4. The first lever 86 is attached to frame 60 by a rivet fastener 90. This permits lever 86 to pivot about the fastener axis. The lever 86 has an arm portion 89 with surface or edge 92 thereon. An actuator rod 94 which is connected to the rotatable portion or pawl 96 of the member 34 is located so as to project adjacent surface 92. When the member 34 is rotated in a counterclockwise direction in FIG. 4, the rod 94 engages surface 92 to pivot the first operating lever 86 counterclockwise. The rotation of lever 86 then moves the connector 84 downward thereby pivoting the detent lever 72 counterclockwise in FIG. 2. After portion 75 moves clear of portion 76, the fork bolt 42 is freed to rotate clockwise about fastener 50, thereby releasing the striker bar 36. Thereafter, the gas cylinders 28, 30 move the window to the open position of FIG. 3. As long as the window remains in the open position, the spring 78 holds the fork bolt 42 in an unlatched position and the interference between the undersurface 98 of the fork bolt and the end portion 75 of the detent lever 72 holds the detent lever 72 and first lever 86 in the release position.

Referring again to FIG. 4, it can be seen that the first lever 86 has a projecting tab-like portion or surface 100 thereon adjacent a shoulder-like portion 102 on a second operating lever member 104. Lever 104 is attached to frame 60 by fastener 106 and is adapted to pivot thereabout in a clockwise direction in response to upward movement of the actuator rod 94 in FIG. 4. However, the blocking action between portions 100 and 102 prevents rotation of lever 104 without first rotating lever 86. Once portion 100 is moved to an unblocking position, rotation of the member 34 in a clockwise direction in FIG. 4 will cause the actuator rod 94 to bear against the surface 107 of lever 104, thus producing clockwise rotation of lever 104.

Rod connectors 108, 110 extend from the lever 104 to lefthand and righthand gate latch mechanisms 112 and 114, which are shown in FIG. 1. The gate latch mechanisms are fairly conventional type latches and reference is hereby made to U.S. Pat. No. 3,400,216 for details of a suitable latch mechanism for this purpose. The clockwise rotation of the second operation lever 104 moves the rods 108 and 110 inward toward the centerline of the gate, thereby releasing the gate portion so it may be pivoted downward to an open position, as shown in FIG. 3.

If it is desired, the subject control assembly lends itself for operation in response to a remote actuator. As shown in FIGS. 1 and 4, the first lever 86 has one end of a link or connector 116 attached thereto. The link is in the form of a cable which passes over a pulley 118 and attaches at the other end to a remote actuator 120. Actuator 120 is preferably in the form of an electrical solenoid type device similar to door lock actuators presently used on General Motors vehicles. The remote system described and illustrated would permit the release of the window portion 20 from the front seat of the vehicle.

Although one embodiment of the subject control and lock assembly for vehicle tailgate has been illustrated and described in detail, various modifications may be made to this specific construction thereof without falling outside the scope of the following claims which define the invention.

What is claimed is as follows:

1. A lock and control assembly for a vehicle tailgate, having a window portion hinged along an upper edge and a gate portion hinged along a lower edge, with the two portions meeting one another at opposite adjacent edges when the tailgate is in a closed operative position, comprising: a frame mounted on the gate portion; releasable means including a bolt and a striker on the frame and window portion respectively for holding the window portion in a closed position in relation to the gate portion; a first actuating lever pivotally mounted on said frame; connector means attaching said first lever to said releasable window means so that pivotal movement of the first lever in one rotational direction releases the window portion for movement from its closed to its open operative position, a second actuating lever pivotally mounted on said frame adjacent said first operating lever, gate latching means movable between latched and unlatched operative positions to maintain the gate portion in a closed position when latched and to release the gate portion for opening movement when in an unlatched position; connecting means between said second lever and said gate latching means so that pivotal movement of the second lever in another rotational direction opposite to said one rotational direction actuates said gate latching means; a remote external actuator on the tailgate portion and in overlying relation to the control assembly for rotating the first and second levers respectively by opposite rotation thereof; blockout means between said first and second levers preventing rotation of the second lever prior to rotation of the first lever thereby requiring the release of said window portion for movement toward the open position before release of said gate portion.

2. A lock and control assembly for a vehicle tailgate, having a window portion hinged along an upper edge and a gate portion hinged along a lower edge, with the two portions meeting one another at opposite adjacent edges when the tailgate is in a closed operative position, comprising: a frame mounted on the gate portion, a bolt member mounted upon said frame for pivotal movement between latched and unlatched operative positions; yieldable means biasing the bolt to an unlatched position; striker means attached to the lower edge of said window portion for engagement with said bolt member when the tailgate is in its closed operative position; a pivotally mounted detent lever supported by said frame to permit movement between detented and released operative positions, respectively, and operative with said bolt to block and unblock movement of said striker from said gate portion as the window portion moves between its closed and its open positions; a first actuating lever pivotally mounted on said frame; connector means attaching said first lever to said detent lever so that pivotal movement of the first lever in one rotational direction moves said detent lever from a detented to a released operative position; a second actuating lever pivotally mounted on said frame adjacent said first operating lever, gate latching means movable between latched and unlatched operative positions to maintain the gate portion in a closed position when latched and to release the gate portion for opening movement when in an unlatched position; connecting means between said second lever and said gate latching means so that pivotal movement of the second lever in another rotational direction opposite to said one rotational direction actuates said gate latching means; an external actuator on the gate portion in overlying relation to the control assembly for rotating the first and second levers respectively by opposite rotation thereof; blockout means between said first and second levers preventing rotation of the second lever prior to rotation of the first lever thereby requiring the release of said window portion for movement toward the open position before release of said gate portion.

3. A lock and control assembly for a vehicle tailgate, having a window portion hinged along an upper edge and a gate portion hinged along a lower edge, with the two portions meeting one another at opposite adjacent edges when the tailgate is in a closed operative position, comprising: a frame mounted on the gate portion, a bolt member mounted upon said frame for pivotal movement between latched and unlatched operative positions; yieldable means biasing the bolt to an unlatched position; striker means attached to the lower edge of said window portion for engagement with said bolt member when the tailgate is in its closed operative position; a pivotally mounted detent lever supported by said frame to permit movement between detented and released operative positions, respectively, and operative with said bolt to block and unblock movement of said striker from said gate portion as the window portion moves between its closed and its open positions; a first actuating lever pivotally mounted on said frame; connector means attaching said first lever to said detent lever so that pivotal movement of the first lever in one rotational direction moves said detent lever from a detented to a released operative position; a second actuating lever pivotally mounted on said frame adjacent said first operating lever, gate latching means movable between latched and unlatched operative positions to maintain the gate portion in a closed position when latched and to release the gate portion for opening movement when in an unlatched position; connecting means between said second lever and said gate latching means so that pivotal movement of the second lever in another rotational direction opposite to said one rotational direction actuates said gate latching means; an external actuator on the gate portion in overlying relation to the control assembly for rotating the first and second levers respectively by opposite rotation thereof; blockout means between said first and second levers preventing rotation of the second lever prior to rotation of the first lever thereby requiring the release of said window portion for movement toward the open position before release of said gate portion; a remotely controlled actuator mounted to said gate portion and operatively connected to said first lever to permit release of the window portion to an open position without manipulation of said external actuator.

* * * * *